US006254399B1

(12) United States Patent
Huang

(10) Patent No.: US 6,254,399 B1
(45) Date of Patent: Jul. 3, 2001

(54) COAXIAL CONNECTOR FOR PRINTED CIRCUIT BOARD

(76) Inventor: Chung-Chuan Huang, No. 92, Sublane 105, Lane 274, Chung-Chen South Road, Yuong-Kang City, Tainan Hsien (TW)

( * ) Notice: Subject to any disclaimer, the term of this patent is extended or adjusted under 35 U.S.C. 154(b) by 0 days.

(21) Appl. No.: 09/583,566

(22) Filed: May 31, 2000

(51) Int. Cl.[7] ..... H01R 12/00
(52) U.S. Cl. ..... 439/63
(58) Field of Search ..... 439/63, 581, 74, 439/79

(56) References Cited

U.S. PATENT DOCUMENTS 4,598,961 * 7/1986 Cohen ..... 439/63
5,334,050 * 8/1994 Andrew ..... 439/759
5,735,695 * 4/1998 Heinrich ..... 439/63
5,904,578 * 5/1999 Kubota et al. ..... 439/63
6,106,304 * 8/2000 Huang ..... 439/63

* cited by examiner

*Primary Examiner*—Brian Sircus
*Assistant Examiner*—J. F. Duverne
(74) *Attorney, Agent, or Firm*—Rosenberg, Klein & Lee

(57) ABSTRACT

A coaxial connector for printed circuit board includes a housing and a coaxial cable is located in a center of the housing. Two prongs extend from two ends of a front end of the housing and the prongs extend toward a direction perpendicular to an axis of the coaxial cable so as to be inserted into two holes in the circuit board. A lower portion extends from the housing and an end facing the prongs of the lower portion has a notch defined therein so that before inserting the two prongs in the holes in the board, an edge of the board is engaged with the notch and then pivoting the board to let the two prongs be inserted into the holes in the board.

2 Claims, 4 Drawing Sheets

COAXIAL CONNECTOR FOR PRINTED CIRCUIT BOARD

FIELD OF THE INVENTION

The present invention relates to a coaxial connector for being securely connected to printed circuit boards. The connector has a casing with two prongs for connecting the board and a notch for receiving a side of the board.

BACKGROUND OF THE INVENTION

In a conventional coaxial connector, there is a coaxial cable located in a center of the housing of the connector and the cable is to be connected to a circuit board by way of soldering, riveting or the any other methods that connects the coaxial cable to the board. In order to fixedly connect the cable to the board, the manufacturers have to put a lot amount of soldering material to the connection. However, too much soldering material will result in a less transportation of signals and the manufacturers will be incurred by a higher cost. On the other hands, if less soldering material is put to the connection, the coaxial cable could be disengaged from the board by vibration or the like. Besides, a typical connector includes a male connector and a female connector which receives the male connector for form the connector. In practice, inadvertent axial and/or rotational movement of a male connector body relative to a female connector body makes providing a satisfactory electrical connection difficult.

The present invention intends to provide a connector that has two prongs for clamp the circuit board securely and a notch for a side of the board to be engaged with. By this way, the connection between the coaxial connector and the circuit board is easy and reliable.

SUMMARY OF THE INVENTION

In accordance with one aspect of the present invention, there is provided a two prongs in the holes in the board and comprising a housing with a coaxial cable located in a center of the housing. Two prongs extend from two ends of a front end of the housing and extend toward a direction perpendicular to an axis of the coaxial cable. A lower portion extends from the housing and a gap is defined between the lower portion and the two prongs. An end facing the prongs of the lower portion has a notch defined therein for receiving an edge of a circuit board.

The object of the present invention is to provide a coaxial connector for connecting to a circuit board wherein the connector has a notch that receives an edge of a board which is then rotated to let two prongs on the connector be inserted into two holes in the circuit board.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
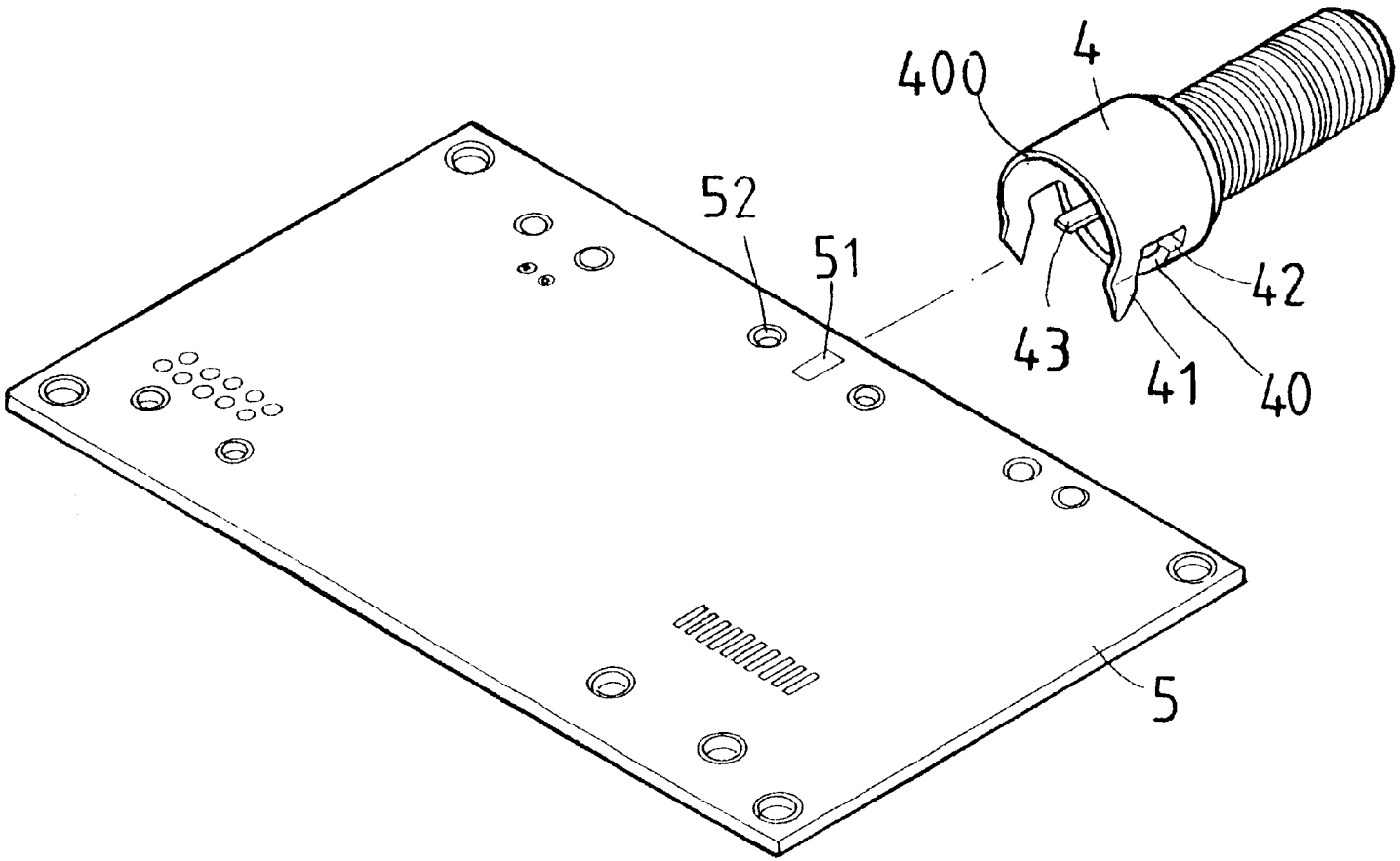
FIG. 1 is an exploded view to show a coaxial connector and a circuit board to be connected to the connector of the present invention.
Figure 2:
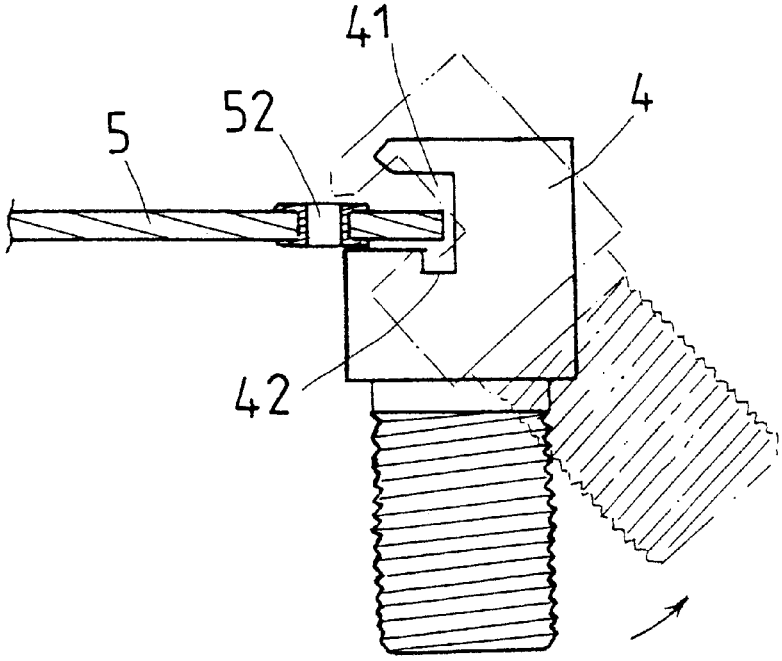
FIG. 2 is an illustrative view to show how to engage an edge of the circuit board with the notch in the connector.
Figure 3:
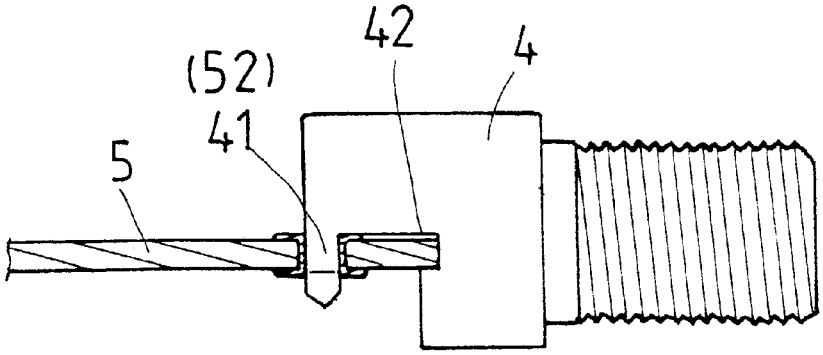
FIG. 3 is an illustrative view to show two prongs of the connector are inserted into holes in the circuit board.

Referring to FIGS. 1 to 3, the coaxial connector in accordance with the present invention comprises a housing 4 which is a tubular member and a coaxial cable 43 is connected to a center of the housing 4. A semi-circular portion 400 extends from a front end of the tubular member and two prongs 41 extend from two ends of an underside the left semi-circular portion of the housing 4. The prongs 41 extend toward a direction perpendicular to an axis of the coaxial cable 43. A lower portion 40 extends from the housing 4 and a gap is defined between the lower portion 40 and the two prongs 41. An end facing the prongs 41 of the lower portion 40 has a notch 42 defined therein.

Figure 4:
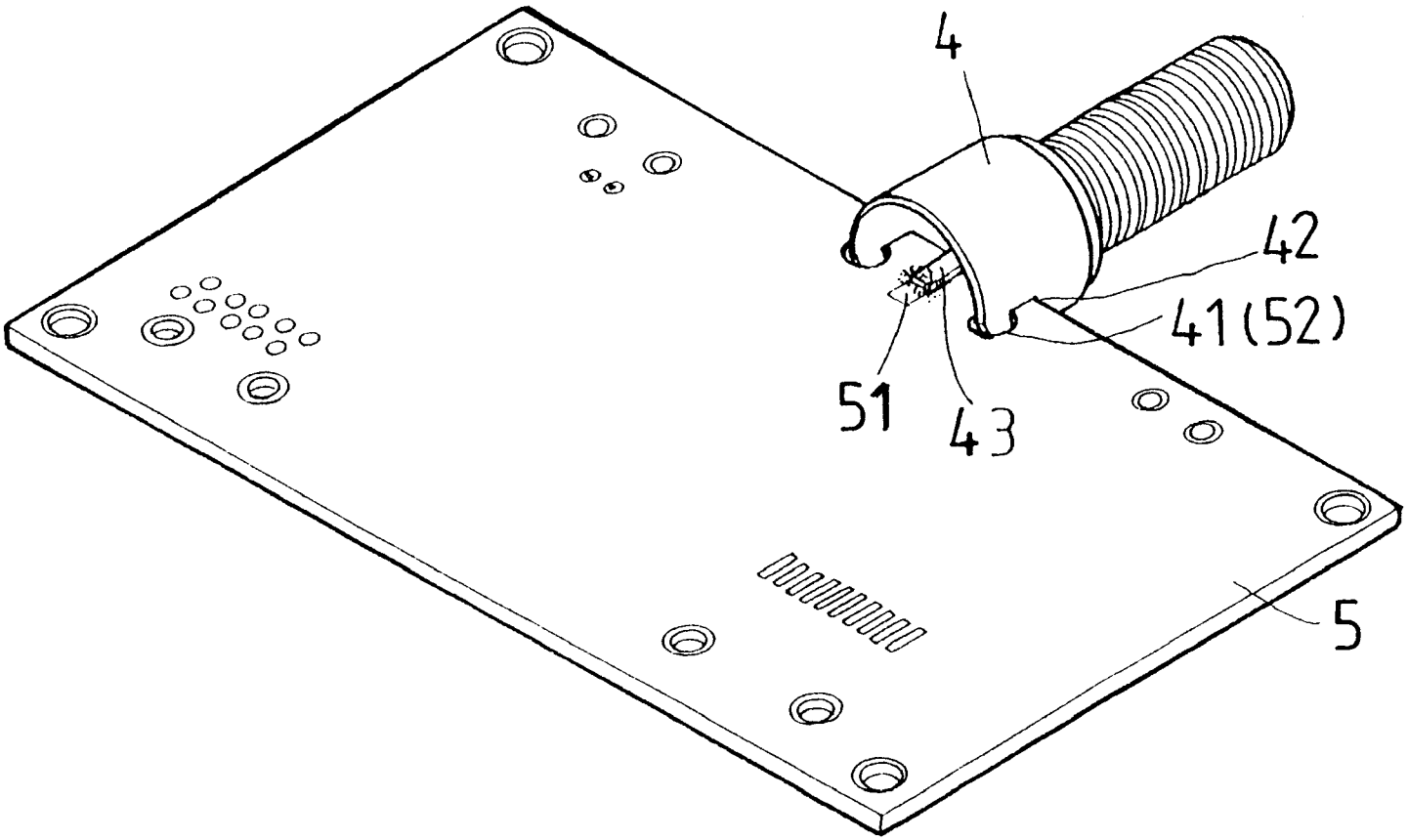
FIG. 4 is a perspective view to show the coaxial connector of the present invention connected to the circuit board.

A circuit board 5 has two holes 52 defined therethrough and a contact area 51 is located between the two holes 52 and located on a surface of the board 5. When connecting the connector to the board 5, an edge of the board 5 is first inserted into the gap between the prongs 41 and the notch 42. The connector is then pivoted to let the edge of the board 5 be engaged with the notch 42 while the two prongs 41 are inserted into the two holes 52 as shown in FIG. 3. As shown in FIG. 4, the coaxial cable 43 is soldered to the contact area 51. The housing 4 is securely connected to the board 5 by the two prongs 41 so that the coaxial cable 43 will not separated from the board 5.

Figure 5:
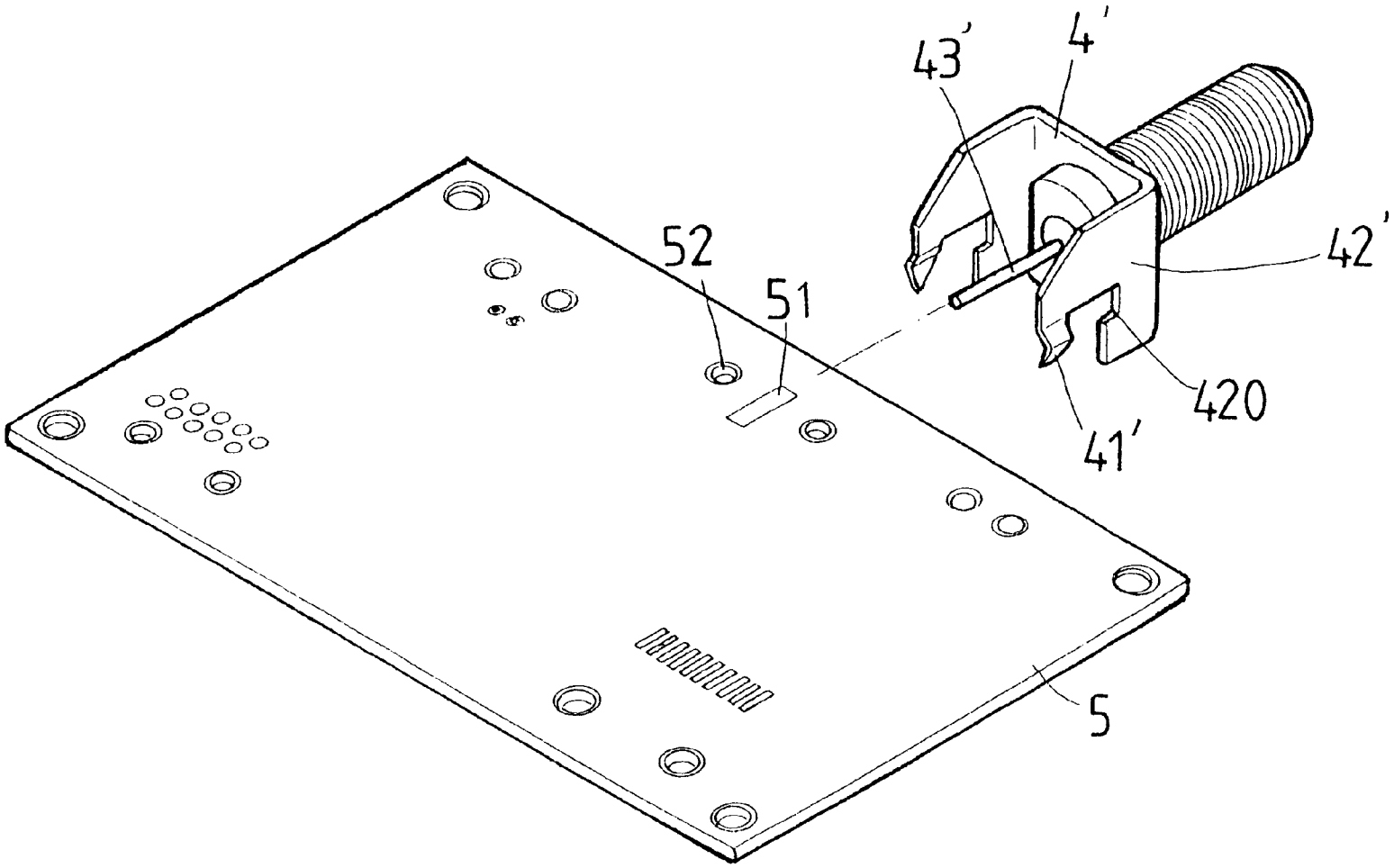
FIG. 5 is an exploded view to show another embodiment of the coaxial connector and a circuit board to be connected to the connector of the present invention.

Another embodiment of the coaxial connector in shown in FIG. 5 and includes an engaging member having a connection plate 4' and two side wings 42' respectively extending perpendicularly from two ends of the connection plate 4'. A coaxial cable 43' extends from a center of the connection plate 4' and a prong 41' extends from a distal end of each side wing 42'. A notch 420 is defined in the distal end of each the side wing 42'. The processes for connecting the connector 5 to the board 5 is the same as described herein before. The edge of the board 5 is to be engaged with the notch 420 and the two prongs 41' are inserted into the holes 52 of the board 5. The coaxial cable 43' is soldered to the contact area 51 on the board 5.

The structure of the connector of the present invention is so simple and the connection between the board 5 and the connector is satisfactory.

While we have shown and described various embodiments in accordance with the present invention, it should be clear to those skilled in the art that further embodiments may be made without departing from the scope and spirit of the present invention.

What is claimed is:

1. A coaxial connector comprising:

a longitudinally extended tubular housing, said housing having a pair of prongs respectively formed on opposing sides of an end portion thereof and extending in a direction perpendicular to a longitudinal axis of said housing for engagement within apertures of a circuit board, each of said opposing sides of said end portion of said housing having a longitudinally directed notch formed therein for engaging an edge portion of the circuit board; and a conductor coaxially extending through said housing for coupling to the circuit board.

2. A coaxial connector comprising:

a longitudinally extended tubular housing;

a conductor coaxially passing through said housing, said conductor having an end portion extending from said housing for coupling to a circuit board; and, a connection plate coupled to an end portion of the housing, said connection plate having a pair of longitudinally extending side wings respectively formed on opposing sides thereof, each said side wing having (a) a prong formed thereon and extending in a direction perpendicular to a longitudinal axis of said housing for engagement within apertures of the circuit board, and (b) a longitudinally directed notch formed therein for engaging an edge portion of the circuit board.

* * * * *